US006186217B1

(12) United States Patent
Sikkenga et al.

(10) Patent No.: US 6,186,217 B1
(45) Date of Patent: Feb. 13, 2001

(54) MULTIPIECE CORE ASSEMBLY

(75) Inventors: William E. Sikkenga, Twin Lake, MI (US); Charles F. Caccavale, Wharton, NJ (US)

(73) Assignee: Howmet Research Corporation, Whitehall, MI (US)

( * ) Notice: Under 35 U.S.C. 154(b), the term of this patent shall be extended for 0 days.

(21) Appl. No.: 09/203,441

(22) Filed: Dec. 1, 1998

(51) Int. Cl.[7] ..... B22C 9/10

(52) U.S. Cl. ..... 164/137; 164/15; 164/28; 164/369

(58) Field of Search ..... 164/137, 369, 164/15, 28

(56) References Cited

U.S. PATENT DOCUMENTS

| | | | |
|---|---|---|---|
| 4,421,153 | 12/1983 | Wilkinson et al. | 164/35 |
| 4,552,197 | 11/1985 | Mills | 164/34 |
| 4,898,635 | 2/1990 | Kobari | 156/245 |
| 5,067,548 | 11/1991 | Uram | 164/15 |
| 5,295,530 | 3/1994 | O'Connor et al. | 164/516 |
| 5,296,308 | 3/1994 | Caccavale et al. | 428/586 |
| 5,394,932 | 3/1995 | Carozza et al. | 164/137 |
| 5,423,372 | 6/1995 | Kearney | 164/137 |
| 5,498,132 | 3/1996 | Carozza et al. | 416/97 R |
| 5,503,218 | 4/1996 | Campion et al. | 164/516 |
| 5,545,033 | 8/1996 | O'Connor et al. | 415/115 |

FOREIGN PATENT DOCUMENTS

| | | | | |
|---|---|---|---|---|
| 273018 | * | 11/1989 | (DE) | 164/137 |
| 2-137644 | * | 5/1990 | (JP) | 164/369 |
| 3-18457 | * | 1/1991 | (JP) | 164/137 |
| 5-185181 | * | 7/1993 | (JP) | 164/137 |
| 6-234042 | * | 8/1994 | (JP) | 164/137 |

* cited by examiner

*Primary Examiner*—J. Reed Batten, Jr.

(57) ABSTRACT

A plurality of individual thin wall, arcuate (e.g. airfoil shaped) core elements are formed in respective master dies to have integral interlocking locating features, the individual core elements are prefired in respective ceramic setter supports to have integral locating features, the prefired core elements are assembled together using the locator features of adjacent core elements, and the assembled core elements are adhered together using ceramic adhesive introduced at internal joints defined between mating interlocked locating features. The multi-wall ceramic core assembly so produced comprises the plurality of spaced apart thin wall, arcuate core elements and joined together by at the internal joints defined between the adhered interlocked locating features.

9 Claims, 2 Drawing Sheets

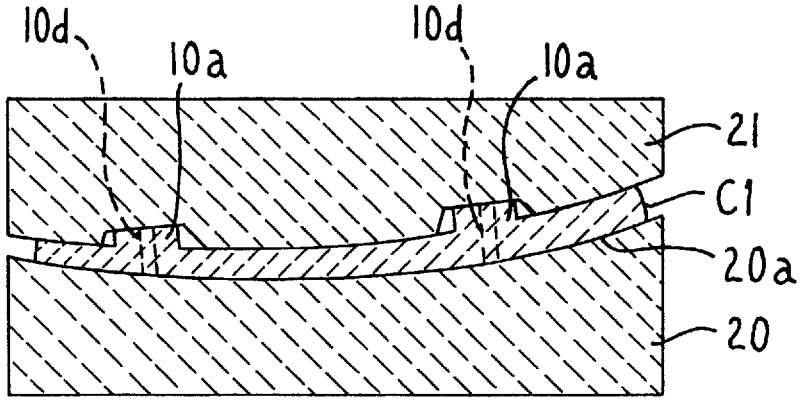
FIG. 2
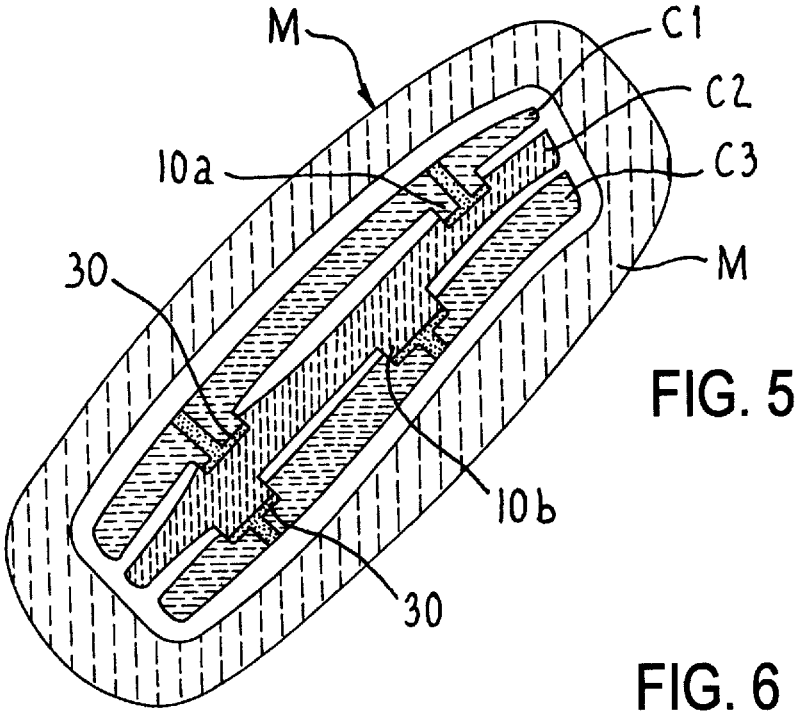
FIG. 5
FIG. 6
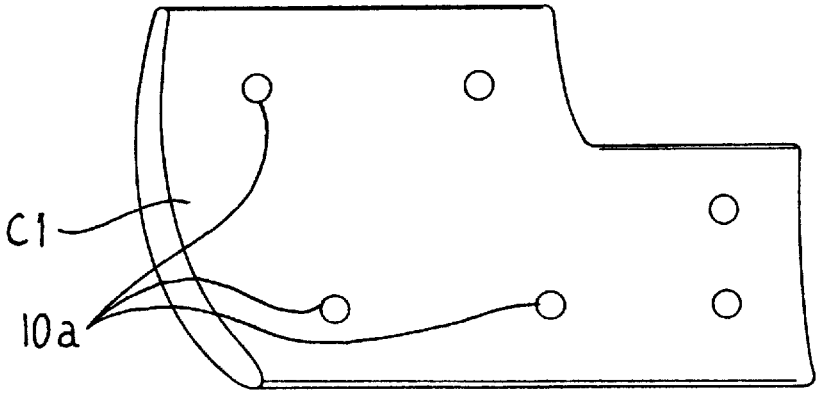

MULTIPIECE CORE ASSEMBLY

FIELD OF THE INVENTION

The present invention relates to complex multi-piece ceramic cores for casting superalloy airfoil castings, such as airfoils having multiple cast walls and complex channels for improved air cooling efficiency.

BACKGROUND OF THE INVENTION

Most manufacturers of gas turbine engines are evaluating advanced multi-walled, thin-walled turbine airfoils (i.e. turbine blade or vane) which include intricate air cooling channels to improve efficiency of airfoil internal cooling to permit greater engine thrust and provide satisfactory airfoil service life.

U.S. Pat. Nos. 5, 295, 530 and 5, 545, 003 describe advanced multi-walled, thin-walled turbine blade or vane designs which include intricate air cooling channels to this end.

In U.S. Pat. No. 5, 295, 530, a multi-wall core assembly is made by coating a first thin wall ceramic core with wax or plastic, a second similar ceramic core is positioned on the first coated ceramic core using temporary locating pins, holes are drilled through the ceramic cores, a locating rod is inserted into each drilled hole and then the second core then is coated with wax or plastic. This sequence is repeated as necessary to build up the multi-wall ceramic core assembly.

This core assembly procedure is quite complex, time consuming and costly as a result of use of the multiple connecting and other rods and drilled holes in the cores to receive the rods. In addition, this core assembly procedure can result in a loss of dimensional accuracy and repeatability of the core assemblies and thus airfoil castings produced using such core assemblies.

An object of the present invention is to provide a multi-wall ceramic core assembly and method of making same for use in casting advanced multi-walled, thin-walled turbine airfoils (e.g. turbine blade or vane castings) which can include complex air cooling channels to improve efficiency of airfoil internal cooling.

Another object of the present invention is to provide a multi-wall ceramic core assembly and method of making same for use in casting advanced multi-walled, thin-walled turbine airfoils wherein a multi-piece core assembly is formed in novel manner which overcomes disadvantages of the previous core assembly techniques.

SUMMARY OF THE INVENTION

The present invention provides, in an illustrative embodiment, a multi-wall ceramic core assembly and method of making same wherein a plurality of individual thin wall, arcuate (e.g airfoil shaped) core elements are formed in respective master dies to have integral interlocking locating features and ceramic adhesive entry holes, the individual core elements are prefired in respective ceramic setter supports, the prefired core elements are assembled together using the locator features of adjacent core elements to effect proper core element positioning relative to one another, and the assembled core elements are adhered together using ceramic adhesive introduced through the preformed adhesive entry holes to the internal joints defined between mating interlocked locator features.

The multi-wall ceramic core assembly so produced comprises the plurality of spaced apart thin wall, arcuate (e.g airfoil shaped) core elements located relative to one another by the integral interlocked locator features and joined together by ceramic adhesive at the internal joints defined between the interlocked locator features.

The present invention is advantageous in that the ceramic core elements can be formed with the interlocking locator features by conventional injection or transfer molding using appropriate ceramic slurries, in that prefiring of the core elements improves their dimensional integrity and permits their inspection prior to assembly to improve yield of acceptable ceramic core assemblies and reduces core assembly costs as a result, and in that high dimensional accuracy and repeatability of core assemblies is achievable.

DESCRIPTION OF THE DRAWINGS

FIG. 2 is an sectional view of an individual core element on a ceramic setter support for core firing.

FIG. 5 is a sectional view showing the core assembly invested in a ceramic investment casting shell mold with wax pattern removed.

FIG. 6 is a perspective view of the individual core element showing an exemplary pattern of preformed locator features on the inner surface.

DESCRIPTION OF THE INVENTION

Referring to FIGS. 1–6, the present invention provides in an illustrative embodiment shown a multi-wall ceramic core assembly 10 and method of making same for use in casting a multi-walled, thin-walled airfoil (not shown) which includes a gas turbine engine turbine blade and vane. The turbine blade or vane can be formed by casting molten superalloy, such as a known nickel or cobalt base superalloy, into ceramic investment shell mold M in which the core assembly 10 is positioned as shown in FIG. 5. The molten superalloy can be directionally solidified as is well known in the mold M about the core 10 to produce a columnar grain or single crystal casting with the ceramic core assembly 10 therein. Alternately, the molten superalloy can be solidified in the mold M to produce an equiaxed grain casting as is well known. The core assembly 10 is removed by chemical leaching or other suitable techniques to leave the cast airfoil with internal passages at regions formerly occupied by the core elements C1, C2, C3 as explained below.

Figure 1:
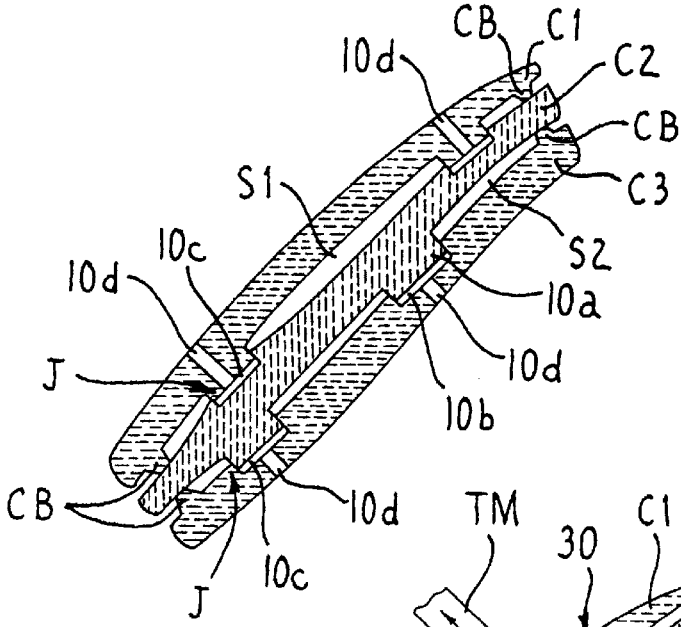
FIG. 1 is a sectional view of a multi-piece ceramic core assembly pursuant to an illustrative embodiment of the invention.
Figure 3:
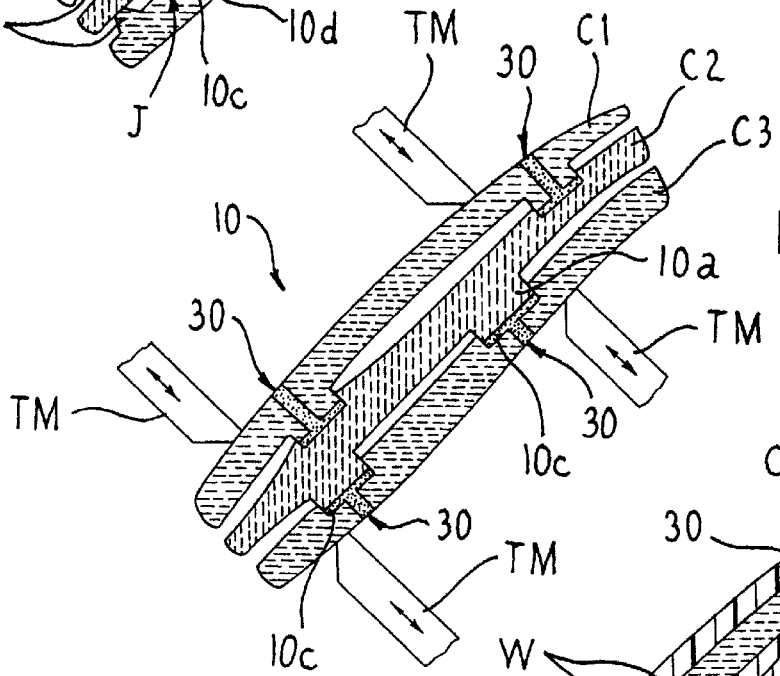
FIG. 3 is a sectional view of the core assembly with ceramic adhesive at the joints and in the preformed adhesive entry holes.
Figure 4:
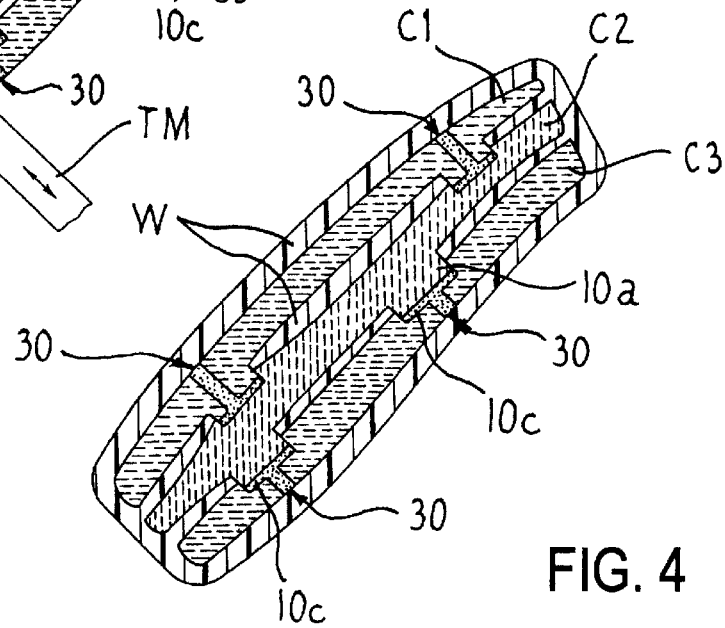
FIG. 4 is a sectional view showing the core assembly showing a wax pattern formed about the core elements.

Referring to FIG. 1, an exemplary core assembly 10 of the invention comprises a plurality (3 shown) of individual thin wall, arcuate core assembly elements C1, C2, C3 that have integral, preformed interlocking locator features comprising cylindrical (or other shape) projections or posts 10*a* on core elements C1, C2 and complementary cylindrical recesses or counterbores 10*b* on core element C2, C3 as shown. The posts 10*a* are received in the recesses 10*b* as shown with a typical clearance of 0.002 to 0.004 inch per side (radial clearance) in FIG. 3 to define internal joints J of the core assembly 10. The clearance between the end of a post 10 and the mating recess 10*b* is in the range of 0.015 to 0.020 inch to form a cavity 10c therebetween to receive adhesive as described below.

The posts 10*a* and recesses 10*b* are arranged in complementary patterns on the core elements C1, C2, C3 in a manner that the posts 10*a* and recesses 10*b* mate together and are effective to join the core elements in prescribed relationship to one another to form internal cast walls and internal cooling air passages in an airfoil to be cast about the core assembly 10 in the mold M, FIG. 5. An exemplary pattern of posts 10*a* on core element C1 is shown in FIG. 6.

The core elements C1, C2, C3 are spaced apart to form spaces S1, S2 therebetween by integral bumpers CB molded on opposing core surfaces pursuant to U.S. Pat. 5, 296, 308, the teachings of which are incorporated herein to this end. The spaces S1, S2 ultimately will be filled with molten superalloy when superalloy is cast about the core assembly 10 in the mold M.

The individual thin wall, arcuate core elements C1, C2, C3 are formed in respective master dies (not shown) to have the arcuate configuration shown and the interlocking locator features 10*a*, 10*b* preformed integrally thereon. The core elements C1, C3 are formed with adhesive entry holes 10*d* that communicate with a respective cavity 10*c* as shown for purposes to be discussed. The core elements can be formed with the arcuate configuration and integral locator and adhesive injection hole features illustrated by injection molding wherein a ceramic slurry is injected into a respective master die configured like respective core elements C1, C2, C3. That is, a master die will be provided for each core element C1, C2, C3 to form that core element with the appropriately positioned locator features 10*a* and/or 10*b* and entry holes 10*d*. U.S. Pat. No. 5, 296, 308 describes injection molding of ceramic cores with integral features and is incorporated herein by reference. Alternately, the core elements can be formed using poured core molding, slip-cast molding or other techniques since the invention is not limited to any particular core forming technique.

In production of a core assembly 10 for casting a superalloy airfoil, such as a gas turbine engine blade or vane, the core elements C1, C2, C3 will have a general airfoil cross-sectional profile with concave and convex sides and leading and trailing edges complementary to the airfoil to be cast as those skilled in the art will appreciate.

The ceramic core elements C1, C2, C3 can comprise silica based, alumina based, zircon based, zirconia based, or other suitable core ceramic materials and mixtures thereof known to those skilled in the art. The particular ceramic core material forms no part of the invention, suitable ceramic core materials being described in U.S. Pat. No. 5, 394, 932. The core material is chosen to be chemically leachable from the airfoil casting formed thereabout as described below.

After molding, the individual green (unfired) core elements are visually inspected on all sides prior to further processing in order that any defective core elements can be discarded and not used in manufacture of the core assembly 10. This capability to inspect the exterior surfaces of the individual core elements is advantageous to increase yield of acceptable core assemblies 10 and reduce core assembly cost.

Following removal from the respective master dies and inspection, the individual green core elements are prefired at elevated temperature in respective sets of ceramic setters 20, 21 (one set shown in FIG. 2 for purposes of illustration only). Each ceramic setter 20 includes an upper support surface 20*a* configured to support the adjacent surface of the core element (e.g. core element C1 in FIG. 3) resting thereon during firing, while the setter 21 resides on the core element. The bottom surface of the ceramic setter 20 is placed on conventional support furniture so that multiple core elements can be loaded into a conventional core firing furnace for firing using conventional core firing parameters dependent upon the particular ceramic material of the core element.

Following removal from the firing furnace, the prefired core elements C1, C2, C3 are assembled together using the preformed locator features 10*a*, 10*b* of adjacent core elements C1, C2 and C2, C3 to effect proper core element positioning and spacing relative to one another in the fixture. The core elements can be manually assembled on a fixture or assembled by suitable robotic devices.

The assembled core elements C1, C2, C3 are adhered together in a fixture or template having template members TM movable to engage and position the core elements relative to one another using ceramic adhesive 30 introduced at joints J defined between the mating locating features 10*a*, 10*b*. The ceramic adhesive 30 can comprise commercially available alumina based, silica based or other paste ceramic adhesive for conventional ceramaic core materials and is introduced into the internal joints J using a syringe inserted into adhesive entry holes 10*d* formed in the core elements C1, C3 and communicating with the internal joints J. The joints J can have a post-in-counterbore configuration as shown wherein a small adhesive receiving cavity 10*c* is defined between the end of each post 10*a* and the bottom of each mating recess 10*b*. The adhesive is introduced to fill each entry hole 10*d* and associated cavity 10*c* with adhesive.

The ceramic adhesive is allowed to set while the assembled core elements C1, C2, C3 reside in the fixture or template to produce the multi-wall ceramic core assembly 10.

After the ceramic adhesive has set, the core assembly 10 is removed from the fixture or template by retracting the movable members TM to allow the adhered core assembly to be further processed. The adhesive entry holes 10*d*, if necessary, can be manually filled with the same ceramic adhesive to a level even with the outer surfaces of each core element. Additional ceramic adhesive also can be used to fill any joint lines where core elements have surfaces that mate or nest with one another, at core print areas, or at other surface areas on exterior core surfaces, the adhesive being smoothed flush with the exterior core surface.

The multi-wall ceramic core assembly 10 so produced comprises the plurality of spaced apart thin wall, arcuate (airfoil shaped) core elements C1, C2, C3 located relative to one another by the integral interlocked locator features 10*a*, 10*b* and joined together by ceramic adhesive 30 at the internal joints J defined between the interlocked locator features.

The multi-wall ceramic core assembly 10 then is further processed to form an investment shell mold thereabout for use in casting superalloy airfoils. In particular, expendable pattern wax, plastic or other material is introduced into the spaces S1, S2 and about the core assembly 10 to form a core/pattern assembly. Typically, the core assembly 10 is placed in a pattern die to this end and molten wax W is injected about the core assembly 10 and into spaces S1, S2 to form a desired multi-walled turbine blade or vane configuration, FIG. 4. The core/pattern assembly then is invested in ceramic mold material pursuant to the well known "lost wax" process by repeated dipping in ceramic slurry, draining excess slurry, and stuccoing with coarse grain ceramic stucco until a shell mold is built-up on the core/pattern assembly to a desired thickness. The shell mold then is fired at elevated temperature to develop mold strength for casting, and the pattern is selectively removed by thermal or chemical dissolution techniques, leaving the shell mold M having the core assembly 10 therein, FIG. 5.

Molten superalloy then is introduced into the mold M with the core assembly 10 therein using conventional casting techniques. The molten superalloy can be directionally solidified in the mold M about the core assembly 10 to form a columnar grain or single crystal airfoil casting. Alternately, the molten superalloy can be solidified to produce an equiaxed grain airfoil casting. The mold M is removed from the solidified casting using a mechanical knock-out operation followed by one or more known chemical leaching or mechanical grit blasting techniques. The core assembly 10 is selectively removed from the solidified airfoil casting by chemical leaching or other conventional core removal techniques. The spaces previously occupied by the core elements C1, C2, C3 comprise internal cooling air passages in the airfoil casting, while the superalloy in the spaces S1, S2 forms internal walls of the airfoil separating the cooling air passages.

The present invention is advantageous in that the ceramic core elements C1, C2, C3 can be formed with the interlocking locator features 10*a*, 10*b* by conventional injection or other molding techniques using appropriate ceramic slurries and in that prefiring of the core elements improves their dimensional integrity and permits their inspection prior to assembly to improve yield of acceptable ceramic core assemblies and reduces core assembly costs as a result.

It will be apparent to those skilled in the art that various modifications and variations can be made in the embodiments of the present invention described above without departing from the spirit and scope of the invention as set forth in the appended claims.

We claim:

1. A method of making a multi-wall ceramic core assembly for casting an airfoil with multiple internal cooling passages, comprising forming a plurality of individual arcuate core elements configured to form the cooling passages in the airfoil and having integral locator features for mating with complementary interlocking locator features of an adjacent core element, firing the core elements, assembling the fired core elements by interlocking the locator features of adjacent core elements to form internal joints that effect core element positioning and spacing relative to one another, and introducing ceramic adhesive through an entry hole communicated to a respective one of said internal joints to join the core elements together as an assembly.

2. The method of claim 1 wherein the core elements are formed by injection molding or by transfer molding.

3. The method of claim 1 wherein the ceramic adhesive is introduced into the internal joints using a syringe inserted into the adhesive entry holes.

4. The method of claim 1 wherein the arcuate core elements have a general airfoil profile for use in casting a turbine airfoil.

5. The method of claim 1 wherein the fired core elements are assembled in a fixture with their locator features interlocked and with the ceramic adhesive introduced at the internal joints.

6. A multi-wall ceramic core assembly for casting an airfoil with multiple internal cooling passages, comprising a plurality of spaced apart arcuate core elements configured to form the cooling passages in the airfoil and located relative to one another by integral locator features on adjacent core elements being interlocked to form internal joints, said core elements being joined together by ceramic adhesive at said internal joints, each of said internal joints having a ceramic adhesive-filled hole extending therefrom.

7. The core assembly of claim 6 wherein the arcuate core elements have a general airfoil profile for use in casting a turbine airfoil.

8. A method of making an airfoil casting having multiple walls defining cooling passages therebetween, comprising positioning the core assembly of claim 6 in a ceramic mold and introducing molten metallic material into the mold about the core assembly.

9. The method of claim 8 wherein the molten metallic material is directionally solidified in the mold.

* * * * *